United States Patent [19]

Byrne

[11] Patent Number: 4,854,042

[45] Date of Patent: Aug. 8, 1989

[54] DIAGONAL BLADE CARTRIDGE

[76] Inventor: John J. Byrne, 73 Andrews Rd., Quincy, Mass. 02170

[21] Appl. No.: 885,466

[22] Filed: Jul. 14, 1986

[51] Int. Cl.[4] ..... E21C 9/00

[52] U.S. Cl. ..... 30/34.1

[58] Field of Search ..... 30/34.1, 32, 48, 50

[56] References Cited

U.S. PATENT DOCUMENTS 2,342,291 2/1944 Morelli ..... 30/50
2,697,874 12/1954 Tomchek ..... 30/50
4,285,124 8/1981 Diakonov ..... 30/34.1
4,534,110 8/1985 Glass ..... 30/50 X

*Primary Examiner*—Donald R. Schran
*Assistant Examiner*—Willmon Fridie, Jr.

[57] ABSTRACT

This invention is directed at a cartridge shaving razor with the cartridge having three razor blades mounted therewith. All of the razor blades are positioned on substantially the same plane with the first blade in angular relation to the second and third blades and the second and third blades in spaced parallel relation to each other.

4 Claims, 1 Drawing Sheet

DIAGONAL BLADE CARTRIDGE

BACKGROUND OF THE INVENTION

This invention relates to safety razors.

SUMMARY OF THE INVENTION

The invention disclosed herein comprises a cartridge safety razor having a head with at least one straight shaving blade and one diagonal shaving blade.

BRIEF DESCRIPTION OF THE DRAWINGS

Further details are explained below with the help of the examples illustrated in the attached drawings in which.

DESCRIPTION OF THE PREFERRED EMBODIMENT(S)

Figure 1:
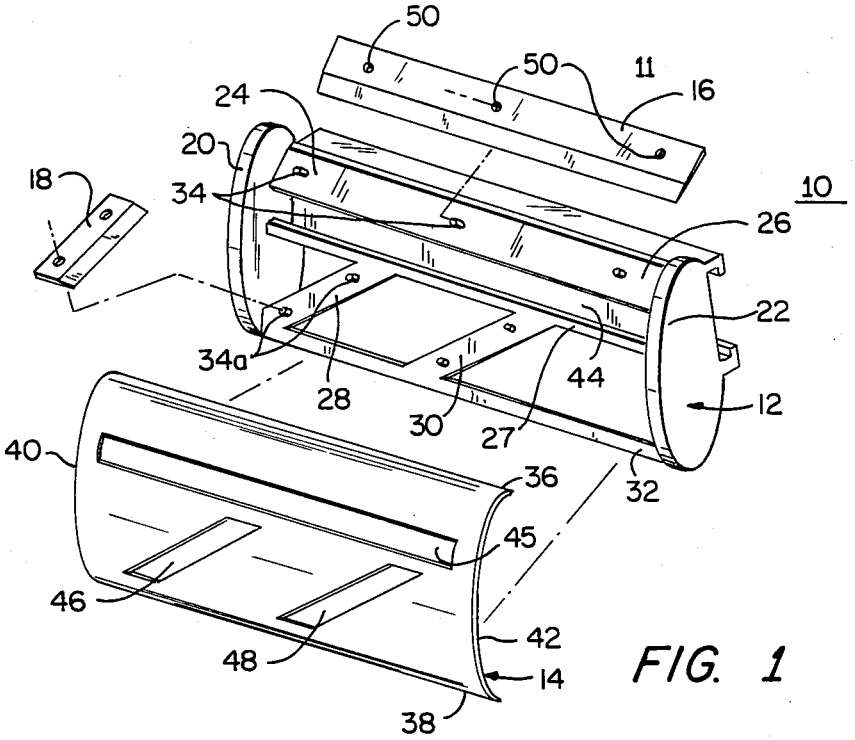
FIG. 1 is an exploded view of the head of the safety razor according to the present invention.
Figure 2:
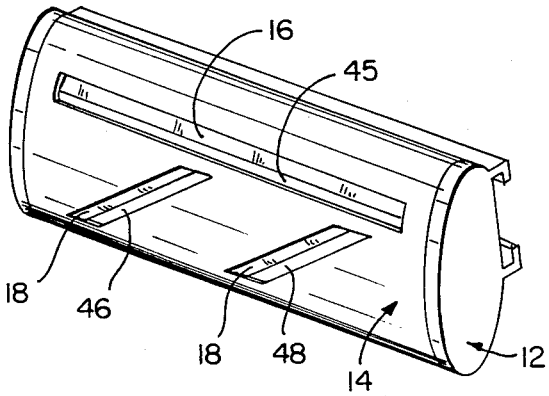
FIG. 2 is an isometric view of the head of the safety razor shown in FIG. 1.
Figure 3:
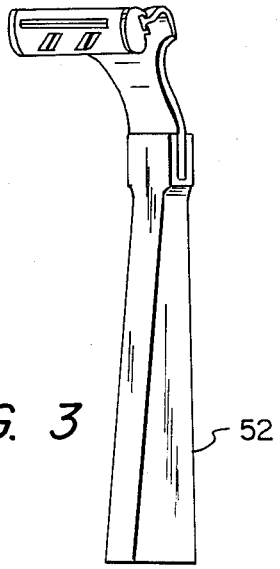
FIG. 3 is an isometric view of the safety razor according to the present invention.

There is shown in the drawings a diagonal blade cartridge 10 comprising a base portion 12, a cap piece 14, a first blade 16 and a pair of second blades 18.

The unitary base portion 12 includes a support element 24 having having a semicircular first end portion 20 extending from one short side edge thereof and a semicircular second end portion 22 extending from the other short side edge thereof. The first end portion 20 and the second end portion 22 are in spaced apart, opposed relation to each other and the arced portions thereof are spaced from the base portion 12. The integral support element 24 extends from the inner face of the first end portion 20 to the inner face of the second end portion 22 as shown in FIG. 1. The support element 24 comprises a rectangular top piece 26, an intermediate strip 27, a first diagonal strip 28, a second diagonal strips 30 and a bottom piece 32. The intermediate strip 27 is spaced from the top piece 26 and is in parallel relation therewith. The first diagonal strip 28 extends from the lower edge of the intermediate strip 27 to the upper edge of the bottom piece 32 adjacent the first end portion 20 and the second diagonal strips 30 extends from the lower edge of the intermediate strip 27 to the upper edge of the bottom piece 32 as shown in FIG. 1. The first diagonal strip 28 and the second diagonal strips 30 are in spaced parallel relation to each other and are in angular relation to the top piece 26, the intermediate strip 27 and the bottom piece 32. A series of three engagement studs 34 extend from the upper surface of the top piece 26. The stud elements 34 are in spaced relation to each other along the midline of the top piece 26. Two engagement stud elements **34*a* extend from the upper surface of the first diagonal strip 28. Two engagement stud elements 34*b* extend from the upper surface of the second diagonal strip 30. the stud elements 34*a* and 34*b* are in spaced relation to each other along the midline of their respective diagnol strips. A first rectangular slot 44, extending from the first end portion 20 to the second end portion 22, is formed between the top piece 26 and the intermediate strip 27**.

The unitary, arced cap piece 14 includes a top edge 36 and a bottom edge 38. The top edge 36 and the bottom edge 38 are connected at their terminal ends by a first side edge 40 and a second side edge 42. The first side edge 40 and the second side edge 42 are in spaced, parallel relation to each other. A second rectangular slot 45, extending from proximte the second side edge 42 to proximate the first side edge 40, is formed between the bottom edge 38 and the top edge 36. The second rectangular slot 45 is in spaced, parallel relation to the top edge 36 and the bottom edge 38. A first diagonal slot 46 is formed through the cap piece 14 between the second rectangular slot 45 and the bottom edge 38 and in spaced, angular relation therewith. The first diagonal slot 46 is proximate the first side edge 40. a second diagonal slot 48 is formed through the cap piece 14 between the second rectangular slot 45 and the bottom edge 38 and in spaced angular relation therewith. The second diagonal slot 48 is proximte the second side edge 42.

Through apertures 50 are formed in the first blade 16 and the second blades 18. The apertures 50 are spaced from each other and are longitudinally aligned on their respective blades.

The base portion 12 and the cap piece 14 of the diagonal blade cartridge 10 are assembled with the first and second blades 16, 18 by positioning the first blade 16 on the top piece 26 and by positioning a second blade 18 on each of the diagonal strips 28, 30. This step is accomplished by superimposing the first blade 16 over the top piece 26 coaxially aligning the stud elements with the apertures 50 and then passing the stud elements 34 through their aligned apertures 50. The first blade 16 is now in superimposed, abutting relationship with the top piece 26. The same type of engagement is accomplished for a second blade 18 on the first and second diagonal strips 28, 30. The blade 16 is attached to the top piece 26 and the blades 18 are attached to their respective strips 28, 30 by, for example, melting the studs, **34, 34*a*, 34*b*, since the base portion 12 and the cap piece 14 are formed of thermoplastic material, onto their respective blades and then smoothing the rough ends of the melted studs. The assembly of the blades and the base portion 12 is then assembled with the cap piece 14**.

What I claim is:

1. A shaving razor comprising a razor blade cartridge and a handle, the handle having cartridge engagement means associated therewith, the razor blade cartridge having a first razor blade attached thereto and having a plane, the first razor blade in angular relation to the plane, the razor blade cartridge including a base portion and a cap piece, the base portion having a support element, the first and second razor blades attached to the support element and the cap piece superimposed on the support element, the base portion including a first end portion and a second end portion, the support element comprising a rectangular top piece, an intermediate strip, a first diagonal strip, a second diagonal strip and a bottom piece, the intermediate strip spaced from the top piece and in parallel relation therewith; the first diagonal strip extends from the lower edge of the intermediate strip to the upper edge of the bottom piece adjacent the first end portion and the second diagonal strip extends from the lower edge of the intermediate strip to the upper edge of the bottom piece, the first and second diagonal strips are in spaced parallel relation to each other and are in angular relation to the top, intermediate and bottom pieces, the first and second diagonal strips, each have an upper surface and a midline, the top piece has an upper surface and a midline, a series of first engagement studs extend from the upper surface of the top piece, the first engagement studs are in spaced relation to each other along the midline of the top piece, second engagement studs extend from the upper surface of the first diagonal strip; third engagement stud elements extend from the upper surface of the second diagonal strip, the third engagement studs and second engagement studs are in spaced relation to each other along the midline of their respective diagonal strips, a first rectangular slot extending from the first end portion to the second end portion, is formed between the top piece and the intermediate strip, the first and second razor blades attached to the support element through the first and second engagement studs and the cap piece includes a top edge a bottom edge, a first side edge and a second side edge, the top edge and the bottom edge having terminal ends and are connected at their terminal ends by the first side edge and the second side edge, the first side edge and the second side edge in spaced, parallel relation to each other, a second slot is formed between the bottom edge and the top edge, the second slot is in spaced, parallel relation to the top edge and the bottom edge, first and second diagonal slots are formed through the cap piece between the second slot and the bottom edge and in spaced, angular relation therewith, the first diagonal slot is proximate the first side edge, the second diagonal slot is proximate the second side edge, through apertures are formed in the first and second blades, the apertures are spaced from each other and are longitudinally aligned on their respective blades; the first blade is superimposed on the top piece and a second blade on the first diagonal strips; the second blade in superimposed, abutting relationship with the first diagonal, the cap piece in superimposed, abutting relation with the support element and the first and second razor blades.

2. A shaving razor comprising a razor blade cartridge and a handle, the handle having cartridge engagement means associated threwith, the handle extending along a longitudinal plane, the razor blade cartridge having a first razor blade attached thereto and having a first plane, the first plane in substantially parallel relation to the longitudinal plane, a second and third razor blades attached to the razor blade cartridge and positioned on the first plane, the first razor blade positioned on the first plane and in angular relation to the second and third razor blades, the razor blades in spaced, parallel relation to each other.

3. A shaving razor as set forth in claim 2 wherein the first razorblade is attached to the razorblade cartridge by a stud means extending from the razorblade cartridge.

4. A shaving razor as set forth in claim 2 wherein the razorblade cartridge includes a base portion and a cap piece, the base portion having a support element, the first and second razorblades attached to the support element and the cap piece superimposed on the support element.

* * * * *